US005606404A

United States Patent [19]

Hilbert et al.

[11] Patent Number: 5,606,404

[45] Date of Patent: Feb. 25, 1997

[54] TONER DEVELOPMENT STATION WITH NON-CONDUCTIVE SKIVE

[75] Inventors: Thomas K. Hilbert, Spencerport; Eric C. Stelter, Pittsford, both of N.Y.

[73] Assignee: Eastman Kodak Company, Rochester, N.Y.

[21] Appl. No.: 563,246

[22] Filed: Nov. 22, 1995

[51] Int. Cl.[6] ..... G03G 15/09

[52] U.S. Cl. ..... 399/267; 399/275

[58] Field of Search ..... 355/245, 251, 355/253; 118/657, 658, 653; 430/122

[56] References Cited

U.S. PATENT DOCUMENTS

| | | | |
|---|---|---|---|
| 4,091,765 | 5/1978 | Lowthorp et al. | 118/658 |
| 4,546,060 | 10/1985 | Miskinis et al. | 430/108 |
| 4,629,669 | 12/1986 | Shoji et al. | 430/122 X |
| 4,878,089 | 10/1989 | Guslits et al. | 355/253 |
| 5,325,161 | 6/1994 | Saha et al. | 355/251 |
| 5,409,791 | 4/1995 | Kaukeinen et al. | 430/122 X |

*Primary Examiner*—Shuk Yin Lee
*Attorney, Agent, or Firm*—Leonard W. Treash, Jr.

[57] ABSTRACT

A development station for applying dry toner to an image member includes a rotatable magnetic core and an input skive to determine the height of the developer nap on a shell surrounding the core. Toner flakes showing up in the toner application on the image member are substantially reduced by replacing a previously metallic skive with a non-conductive skive to prevent heating of the skive from eddy currents created by the rotating core.

5 Claims, 1 Drawing Sheet

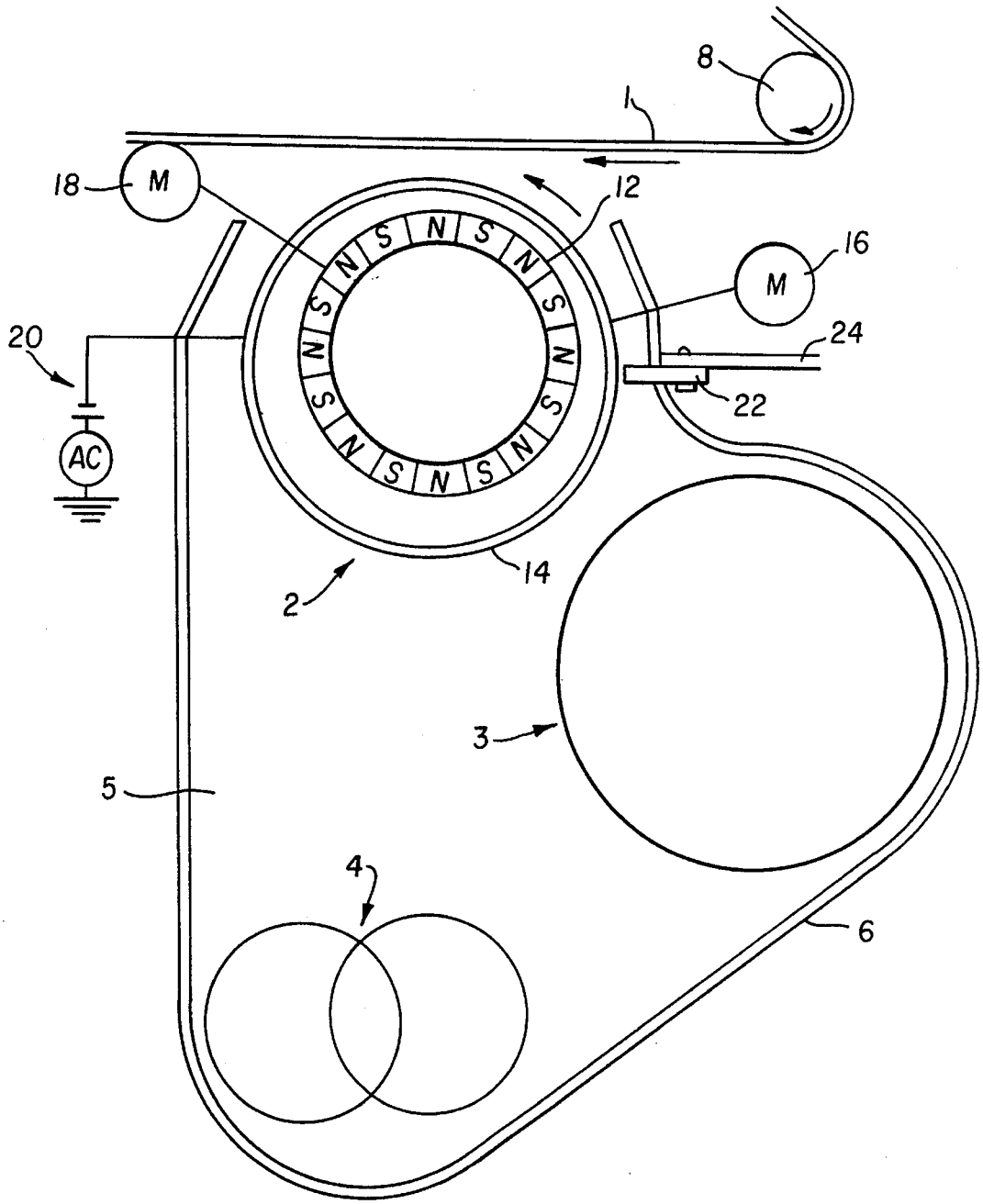
8
1
18
M
12
16
M
20
24
22
AC
14
2
3
5
4
6

TONER DEVELOPMENT STATION WITH NON-CONDUCTIVE SKIVE

This invention relates to a development station for applying dry toner to an image member, for example, for the development of electrostatic images.

U.S. Pat. No. 4,546,060 to Miskinis et al, describes a method and apparatus for toning electrostatic images in which a multipole rotatable magnetic core is rapidly rotated inside a shell which may or may not be rotated itself. Movement of the shell and/or core move a developer having hard magnetic carrier particles and an insulative toner rapidly through a development zone while vigorously mixing and tumbling the developer. This toning approach has been used commercially and provides extremely high quality development of electrostatic images at very high speed.

Although all present commercial applications of this toning process bring the developer into direct contact with the image member carrying the electrostatic image, it has also been shown to be effective with projection toning. See, for example, U.S. Pat. No. 5,409,791 to Kaukeinen et al, in which effective high speed projection development is accomplished with such an apparatus in which the conventional development electrical field is augmented with an AC component.

In commercially implementing this process in both contact and projection modes, problems were encountered with the heat generated by rapid rotation of a strong magnetic core. These problems were reduced by a number of improvements. See, for example, U.S. Pat. No. 5,325,161 to Saha et al, suggesting use of a plastic shell with a thin metallic coating to reduce heat buildup.

SUMMARY OF THE INVENTION

In the above process, an input skive is placed slightly separated from the shell, upstream of the development zone to control the nap height of the developer as it approaches the development zone. We have found that substantial flaking of the toner has occurred which adversely affects the development of the electrostatic image. We have traced that flaking to a tendency of the skive to overheat from eddy currents in the skive caused by rapid rotation of the magnetic core. This has especially become a problem in using the system for projection toning because the skive is positioned somewhat closer to the shell to produce a somewhat lower nap height useful in projection toning. Also, arcing can occur from the electrically-biased shell to the skive.

It is an object of the invention to solve such problems associated with the overheating of the skive in a development station having a rotating magnetic core.

These and other objects are accomplished by substituting an electrically non-conductive skive for the conventional metallic skive used in such toning systems.

Although the invention has application to all rotating magnetic core systems, it is particularly useful in systems in which the skive is placed particularly close to the shell, for example, in projection toning systems.

BRIEF DESCRIPTION OF THE DRAWING

The single FIGURE is a side schematic of a development station.

DETAILED DESCRIPTION OF THE INVENTION

Referring to the FIGURE, an image member 1 is to have dry toner applied to it. For example, it can be a photoconductive image member transported through a series of stations by a transport means, for example, a drive roller 8. An electrostatic image is formed on image member 1 which is to be developed by the application of dry toner. It is also known to apply dry toner to non-electrostatic image bearing surfaces. For example, intermediate transfer rollers can advantageously receive a uniform layer of colorless toner before receiving toner images. There are also other systems in which a uniform layer of black or other colored toner is applied to an image member and later imagewise fused. Although the invention is particularly well adapted for applying dry toner to an electrostatic image on an image member, it also has application to these other systems.

A development station for applying dry toner to image member 1 includes an applicator 2, a developer supply device 3 and a mixing device 4 all encased in a housing 6, which housing defines a sump 5 for holding a two component developer. The two component developer is made up of dry toner and magnetic carrier. For best results, the magnetic carrier has a high coercivity and is permanently magnetized or magnetizable. This arrangement of components and the use of permanently magnetized, high coercivity (sometimes herein called "hard") developer is commercially used and well known. See, for example, the aforementioned U.S. Pat. No. 4,546,060, and also to U.S. Pat. No. 4,878,089 to Guslitz et al, granted Oct. 31, 1989. These two references are hereby incorporated by reference herein.

Conventionally, applicator 2 includes a rotatable magnetic core 12 and a shell 14 around the core. Core 12 can be driven in either direction and will have a tendency to drive the developer in the opposite direction due to the rapidly changing magnetic field on the surface of shell 14. Shell 14 can be driven in either direction or remain stationary and has a tendency to drive the developer in the same direction as it is rotated, if it is not stationary. If the shell is driven in a counter-clockwise direction and the core in a clockwise direction, as shown in the FIGURE, both movements have a tendency to move the developer in a counter-clockwise direction which brings it through a development zone facing image member 1, while moving in the same direction as image member 1. Conventionally, the core is driven at greater than 500 revolutions per minute and, preferably, at 2,000 revolutions per minute or more.

Although it is preferable that the developer move in the same direction as the image member in the development zone and at roughly the same speed as the image member, this can be accomplished even though one of the shell or core is rotated in a direction which tends to move the developer counter to that direction of flow. For example, if the shell is rotated fairly rapidly in a counter-clockwise direction, the developer can be moved in that counter-clockwise direction at a fast enough speed to develop an electrostatic image on image member 1, even though the core is also moved in a counter-clockwise direction. In such an arrangement, the rotation of the core has primarily a mixing function, while the rotation of the shell drives the developer through the development zone. Similarly, the core can be rotated in a clockwise direction to predominantly drive the developer in a counter-clockwise direction while the shell is rotated in also a clockwise direction to resist such movement and also have a bit of a mixing effect on the developer whose movement is then entirely driven by the core.

Thus, it is conventional to have separate drives 18 for driving the core and 16 for driving the shell. Various combinations of shell and core speeds provide various subtle effects in the development of the electrostatic image.

A power source 20 applies a DC bias to the shell to create a conventional electric field in the development zone designed to apply toner according to the particular process involved. When developing an electrostatic image, the bias is chosen so that the field encourages the deposition of toner in image areas and discourages deposition of toner in background areas. If uniform toner application is desired, of course, the field is created to accomplish this. It has also been found advantageous to superimpose an alternating current signal on the DC field. This alternating current signal increases the deposition of toner in projection toning systems, systems in which the nap on the developer does not ordinarily touch the image member and reduces the carry out of carrier in contact toning systems in which the nap, in fact, touches the image member.

Note that the core 12 rotates on an axis of rotation that is offset toward the image member from the axis of rotation of shell 14 and also is offset somewhat in an upstream direction to provide the strongest nap as the developer approaches the development zone and to provide a reduction in magnetic field away from the development zone to allow used developer to drop into sump 5.

The height of the nap is controlled by an input skive 22 which is positioned upstream from the development zone and is spaced from the shell to limit the height of the developer moving into the development zone. Skive 22 is attached to a mechanism plate of the apparatus through a conventional attaching mechanism 24 which generally is structured so that the spacing of the skive 22 from the shell 14 can be adjusted. Typical distances for skive 22 from shell 14 are between 0.33 and 0.43 millimeters.

These skives have always been metallic in construction for durability. However, we have found in more precise work that as the skive distance from the shell is made smaller, eddy currents are created in the skive from the rapid pole transitions associated with the rotating magnetic core. These eddy currents create substantial heating in the skive which can soften the toner touching it. Although this may show up with toner melted to the skive or otherwise sticking to the skive, a more serious problem shows up as larger flakes of toner in the developer mix which adversely affect the application of toner to the image member.

The appearance of toner flakes of substantial size in the image showed up more prominently in AC projection toning experiments than in prior commercial contact toning applications of this technology. We concluded that this was due to the lower nap height desired for projection toning which was effected by reducing the spacing of the skive. We then concluded that skive overheating from the eddy currents was causing the flaking. We have solved this problem and greatly reduced the flaking by substituting a non-conductive (electrically insulating) skive for the metallic skive previously used. Although the non-conductive skive reduces the flaking greatest in projection toning where such flaking was the largest problem, there is also a reduction in the existence of flakes in conventional contact toning using a rotating magnetic core. We also eliminated a condition of electrical arcing between the skive and the shell, which occasionally occurred with a conductive skive.

Any non-conductive and durable material can be used for the skive. We have found good results using a composite fiberglass and epoxy circuit board material which is totally non-conductive and reasonably durable. Almost any non-durable metallic material works that has a bulk resistivity higher than $10^4$ Ohm-meter.

The invention has been described in detail with particular reference to a preferred embodiment thereof, but it will be understood that variations and modifications can be effected within the spirit and scope of the invention as described hereinabove and as defined in the appended claims.

We claim:

1. A development station for applying dry toner to an image member from a developer of dry toner particles and hard magnetic carrier particles, said station comprising:

a rotatable magnetic core, means for rotating said magnetic core greater than 500 revolutions per minute, a shell around said core, which shell is rotatable or not rotatable, the combined effect of the rotation of the core and any rotation of the shell being to move the developer through a development zone facing the image member, the developer having a height from the shell as it moves, and a non-conductive skive positioned upstream from the development zone and spaced from the shell to limit the height of the developer moving into the development zone.

2. A development station according to claim 1 wherein said non-conductive skive is made of a material having a bulk resistivity of at least $10^4$ Ohm-meter.

3. A development station according to claim 1 wherein the non-conductive skive is positioned to limit the height of the developer on the shell as the developer passes through the development zone to prevent the developer from touching the image member.

4. A development station according to claim 1 including means for rotating the shell and core in the same direction to drive the developer in the same direction through the development zone.

5. A development station according to claim 1 including means for rotating the core and the shell in opposite directions to drive the developer in a direction which is the same direction as the image member is moving in the development zone.

* * * * *